United States Patent [19]

Taplin

[11] Patent Number: 4,540,020

[45] Date of Patent: Sep. 10, 1985

[54] SUPPLY CONTROL VALVE WITH INTEGRAL PRESSURE LIMITER

[76] Inventor: John F. Taplin, 15 Sewall St., West Newton, Mass. 02165

[21] Appl. No.: 602,420

[22] Filed: Apr. 20, 1984

[51] Int. Cl.[3] ..... F15B 13/043

[52] U.S. Cl. ..... 137/596.15; 91/454; 137/596.16

[58] Field of Search ..... 91/454, 461, 467; 137/106, 596.14, 596.15, 596.16, 596.17, 625.2, 625.44, 625.65, 870; 251/24, 61.1

[56] References Cited

U.S. PATENT DOCUMENTS

| | | | |
|---|---|---|---|
| Re. 29,481 | 11/1977 | Larner | 137/596.16 X |
| 2,911,005 | 11/1959 | Adelson | 137/596.15 |
| 2,990,852 | 7/1961 | Siman et al. . | |
| 3,794,075 | 2/1974 | Stoll et al. | 137/625.66 |
| 4,385,639 | 5/1983 | Holborow | 137/596.15 X |

*Primary Examiner*—Gerald A. Michalsky
*Attorney, Agent, or Firm*—Hamilton, Brook, Smith & Reynolds

[57] ABSTRACT

In a pilot operated fluid supply valve the usual control pressure applied to the control surface of a main supply valve can be interrupted by a fluid switch and replaced with a pressure which closes the main supply valve. The fluid switch is responsive to the load pressure in the load port of the main valve. The fluid switch may include a rocker arm actuated by a diaphragm in fluid communication with the load port. In one system, main supply and waste diaphragm valves are controlled by a pilot valve and a pressure reversing valve, and the fluid switch is positioned between one of those valves and the main supply valve. In another system, the main valves are controlled by a dual output pilot valve.

12 Claims, 14 Drawing Figures

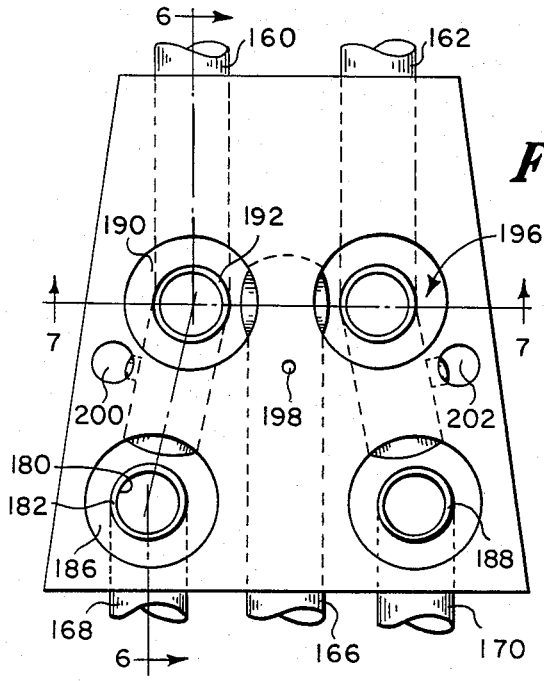
Fig. 5
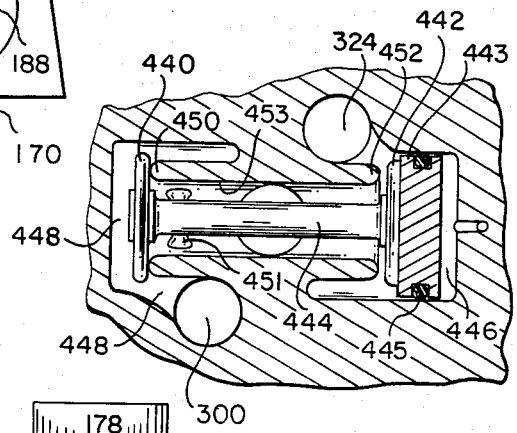
Fig. 12
Fig. 10
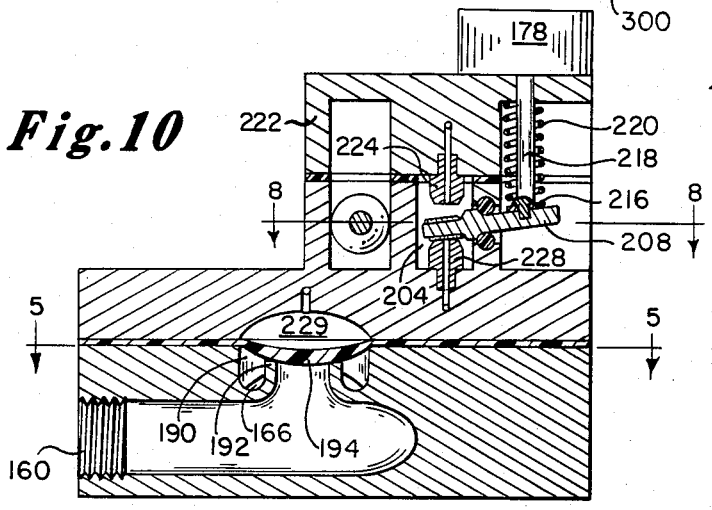

SUPPLY CONTROL VALVE WITH INTEGRAL PRESSURE LIMITER

CROSS REFERENCE TO RELATED APPLICATION

Pilot Operated Supply and Waste Control Valve, Ser. No. 602,438, filed Apr. 20, 1984, by John F. Taplin.

FIELD OF THE INVENTION

The present invention relates to fluid control systems in which supply fluid is controlled by a pilot operated fluid supply valve and in which the supply pressure applied to a load is pressure limited.

BACKGROUND

In fluid operated systems, both pneumatic and hydraulic, various pressure levels may be required throughout the system. To provide those various pressure levels, a high line pressure is reduced by use of pressure reducing valves wherever lower supply pressure levels are required. These pressure reducing valves add to the cost of the system, to the installation complexity and to maintenance costs. Pressure reducing valves also add restrictions to the system flow, even when fully open, and thus increase the energy requirements of the system. Further, in order to compensate for the reduced flow through the restrictions of the open reducing valves, larger main supply valves in the control valves are required. Thus, the cost of the system is increased not only by the cost of the pressure reducing valves themselves but also by the cost of providing larger supply valves.

A primary application of pressure reducing valves is in limiting the pressure applied during the return stroke of a piston after it is driven by full line pressure. In conventional systems, supply pressure is applied to and vented from each end of a cylinder by a four-way supply and waste control valve. In a four-way valve, the fluid is supplied to a first load conduit as it is exhausted from a second conduit, and thereafter the fluid is exhausted from the first conduit and supplied to the second conduit. Thus, as high pressure fluid is supplied through a first load conduit to a first end of the cylinder, it is exhausted from the second end of the cylinder through the second load conduit. Thereafter, the high pressure fluid is supplied to the second end of the cylinder through the second load conduit and is exhausted from the first end of the cylinder through the first load conduit. Where less than full line pressure is required to drive the piston in either or both directions, one or more pressure reducing valves can be positioned in the load conduits between the four-way supply and waste control valve and the cylinder.

DISCLOSURE OF THE INVENTION

A pilot operated fluid supply valve comprises a main supply valve communicating with a load port. Pilot operated control means controls fluid control pressure on a control surface of the main supply valve to open and close the supply valve. To that extent, the supply valve operates as a conventional pilot operated supply valve and may be included in either a three-way or four-way valve. The fluid supply valve further includes a fluid switch responsive to load pressure at the load port. When the load pressure reaches a predetermined level, the fluid switch switches the control pressure on the control surface of the main supply valve to a level which closes the main supply valve.

The switch may be bistable and thus make a quick transition from one control pressure to another at a definite preset level of load pressure. Alternatively, the control pressure from the switch may be modulated by the load pressure. In that configuration, the main supply valve goes from fully open to fully closed through a range of load pressures.

Preferably, the fluid switch is itself a three-way supply and pass through valve. When the load pressure is below the predetermined level, the switch passes the control pressure from the pilot operated control means. However, when the load pressure exceeds the predetermined level, the control conduit from the pilot operated control means to the supply valve is closed, and that control pressure is replaced through the switch with a pressure which closes the supply valve.

In a preferred embodiment, the fluid switch is actuated by a diaphragm. The control surface of the diaphragm is in communication with the load port. The diaphragm actuates a rocker arm which acts to close a pilot control pass through port and to open a high pressure control port. The pressure from the port which is left open by the rocker arm is transmitted through a control conduit to the control surface of the supply valve.

In a preferred embodiment of the supply and waste control valve, a supply diaphragm valve and a waste diaphragm valve are associated with each load port. Control valve means applies a high or low control pressure to the control surface on a supply diaphragm, and reverse, low or high, control pressure to the control surface of the waste diaphragm associated with the same load port. The same control valve means may also control a second pair of supply and waste control valves. A fluid switch may be placed in either or both of the conduits between the control valve means and the control surfaces of the main supply valves. The control valve means may be a pilot valve and a pressure reversing valve or it may be a single four-way pilot valve.

The high control pressure delivered by both the main control valves and the fluid switches may be derived from the supply pressure. In this respect, it should be recognized that the terms "high" and "low" are used in a relative sense. If the supply pressure is low, the "high" pressure may in fact be quite low in an absolute sense but at least higher than the "low" pressure.

The three primary embodiments of the invention are a three-way supply and waste control valve in which supply pressure is applied to or exhausted from a single load port, a four-way supply and waste control valve in which fluid is supplied to and exhausted from two load ports and only one supply valve is controlled by a fluid switch, and a four-way supply and waste control valve in which both supply valves are controlled by fluid switches.

In a preferred construction of a control valve embodying the present invention, the main supply, waste and load conduits are formed in a first block with the valve seats of the main valves formed along a surface of that block. The main diaphragms, fluid switch diaphragms and any control diaphragms are formed in a single sheet of material which also serves as a gasket between the main conduit block and a control conduit block. The fluid switches and control valves are formed in the control block.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 5 is a plan view of the main block of the embodiment of FIG. 4;

FIG. 10 is a partial cross sectional view of the valve of FIG. 4 taken along line 10—10 of Fig. 8;

FIG. 12 is an illustration of an alternative main supply and waste valves for use in the embodiment of FIG. 11;

DESCRIPTION OF PREFERRED EMBODIMENTS

Figure 1:
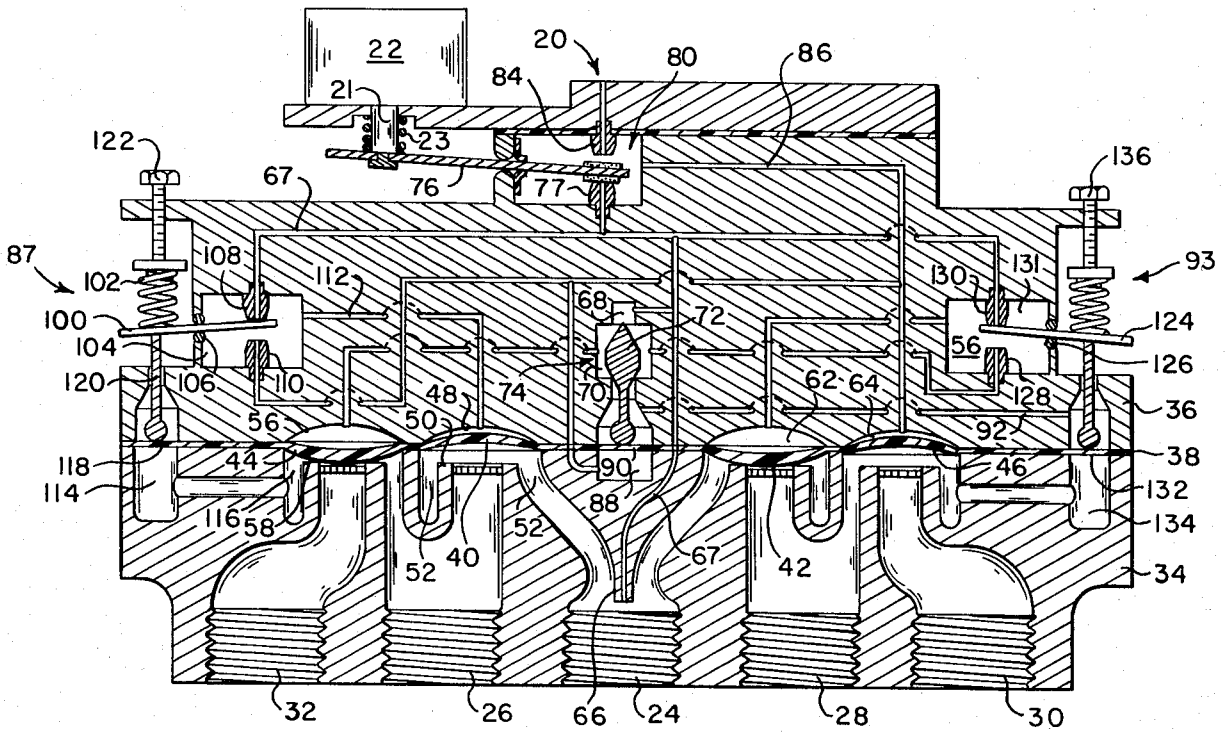
FIG. 1 is a cross sectional view of a four-way supply and waste control valve embodying the present invention and incorporating a solenoid actuated pilot valve, a pressure actuated pressure reversing valve, and a fluid switch associated with each main supply valve.
Figure 2:
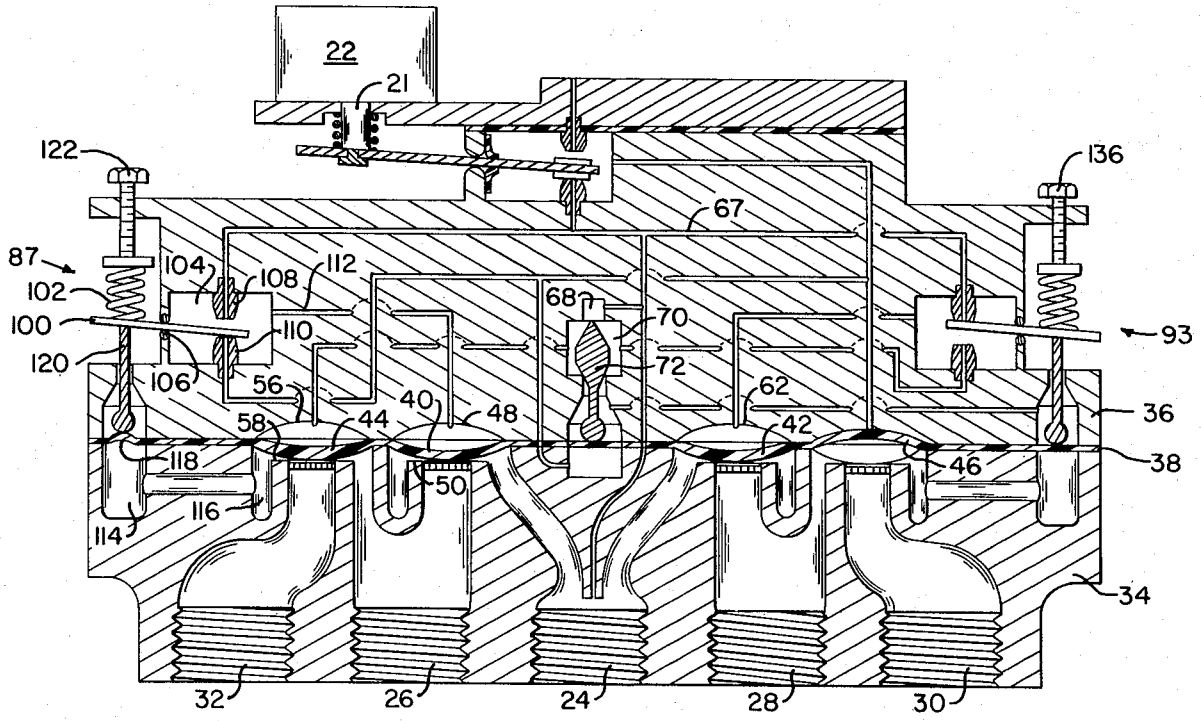
FIG. 2 is a cross sectional view of the valve of FIG. 1 but showing a supply valve closed by a fluid switch.

A pilot operated four-way supply and waste control valve embodying this invention is shown in FIGS. 1 and 2. FIG. 1 shows the response of the valve to the pilot valve 20 before either load pressure reaches a predetermined maximum level. When the solenoid 22 is energized to pull up the armature 21 as shown in FIG. 1, supply fluid, which may be hydraulic or pneumatic, is directed from a supply port 24 to a load port 26. From the port 26, the supply fluid may be applied, for example, to one end of a piston cylinder. At the same time, waste fluid is vented from a load port 28 to a waste port 30. The port 28 may, for example, be connected to the opposite end of a piston cylinder.

When the solenoid 22 is not energized and the armature 21 is pressed down by the compression spring 23 the valving of the supply and waste ports to the two load ports 26 and 28 is reversed. Specifically, the supply fluid is applied to the port 28, and port 26 is vented through a waste port 32. Waste ports 30 and 32 may be connected so that the valve operates as a four port control valve with one supply port, one waste port and two load ports.

The main valve assembly comprises a lower main fluid handling block 34 and an upper control block 36. Crossings of non-interconnected control pressure conduits are indicated by broken lines.

The blocks 34 and 36 are separated by a flexible gasket 38. Four main diaphragms are formed in that gasket. They include two supply diaphragms 40 and 42 and two waste diaphragms 44 and 46. The positions of those diaphragms are controlled by high and low pressures applied to their upper, control surfaces through conduits in the control block 36. For example, as shown in FIG. 1, a lower pressure is applied to the control chamber 48 on the top of diaphragm 40 and the diaphragm is pushed away from its annular valve seat 50 by the higher supply pressure applied to the annulus 52 from the supply port 24. The supply fluid is therefore free to flow into the load port 26 and to the load connected to that port. Higher pressure is applied to the control chamber 56 on top of diaphragm 44 associated with the load port 26. That higher control pressure presses the diaphragm 44 against its annular valve seat 58 to close the passage from the port 26 to the waste port 32.

It can be seen that the supply and waste valves associated with load port 28 are operated conversely to those associated with port 26. Thus, higher pressure is applied to the control chamber 62 to close that supply diaphragm valve, and lower pressure is applied to the control chamber 64 on top of diaphragm 46 to open that waste valve. However, when the solenoid is not energized the armature 21 is dropped (this condition not shown in FIGS. 1 or 2). Thus, control pressures are reversed such that the supply diaphragm valve to port 26 is closed while the waste diaphragm valve from port 26 is open, and the supply diaphragm valve to port 28 is open while the waste diaphragm valve from that port is closed.

The derivation of the control pressures will now be described. It should first be noted that the valve shown in FIGS. 1 and 2 is self-powered in that each control pressure is either ambient pressure or a higher pressure obtained from the supply fluid applied to port 24. To that end, a ram nozzle 66 is directed into a point in the supply fluid. The resultant pressure in control conduit 67 is slightly higher than that at the supply port 24 by a ram pressure $\Delta P$. The ram pressure $\Delta P$ can be defined by the following function:

$$\Delta P = \tfrac{1}{2}(Q/A_T)^2(\rho/g) \qquad (1)$$

where Q is the supply fluid flow at an absolute pressure Pa, $A_T$ is the total flow area of supply fluid past the end of the ram nozzle, $\rho$ is the fluid density at Pa and g is acceleration due to gravity. The pressure $Pa+\Delta P$ obtained in the ram nozzle 66 is the higher control pressure applied throughout the control network including the control chambers behind the main diaphragm valves.

In some instances the mechanical load of the diaphragm against the supply seat is sufficient to insure adequate seat closure. In such cases it is not necessary to employ a ram nozzle so that the higher control pressure in conduit 67 is not augmented.

In a typical case, a system of FIG. 1 might provide a flow rate of 590 cubic inches per second through a flow area $A_T$ of 0.2 square inches where the absolute pressure of the supply fluid is 99.7 pounds per square inch (85 psi gauge). From equation 1, where the supply fluid is air:

$$\Delta P = \tfrac{1}{2}(590/.2)^2\,(3.3 \times 10^{-4})/384$$
$$= 3.74 \text{ pounds per square inch}$$

Thus, the control pressure applied to the control faces of the diaphragms exceeds the pressure of the supply fluid by at least three pounds per square inch to assure firm seating of the diaphragms against the valve seats.

The higher control pressure from the ram nozzle is applied to a high pressure port 68 above a reversed-pressure chamber 70. From the port 68, the high pressure acts downward against a valve member 72 of a pressure reversing valve shown generally at 74.

When the solenoid is energized and the armature 21 is pulled up as shown in FIG. 1, it forces a valve member 76 against a valve seat 77 in pilot valve 20. Chamber 80 is thereby closed to the high pressure line 67 leading from the ram nozzle 66. The chamber 80 is open to a lower pressure, such as atmospheric pressure, through a port 84. The pressure in pilot valve chamber 80, which in this case is low, is applied through a control conduit 86 to the control chamber 64 associated with the waste valve of the load port 28. The low pressure in the pilot valve chamber 80 is also applied, through a fluid switch 87 which will be described, to the control chamber 48 associated with the supply valve of the load port 26. Thus those valves are opened together.

The same low pressure is also applied to a control pressure chamber 88 in the reversing valve 74. The chamber 88 is closed by a diaphragm 90 which is formed in the gasket 38. The opposite face of the diaphragm 90 is always exposed to low ambient pressure through a conduit 92. As previously noted, high pressure is always applied to the upper surface of the valve member 72 of the reversing valve, and that higher pressure drives the valve member downward against the diaphragm 90 exposed to the low pressure in the control pressure chamber 88. The valve member 72 thus rests against its lower valve seat to close the reversed pressure chamber 70 from the ambient pressure above the diaphragm and to open that chamber to a higher pressure in port 68.

The pressure in the reversed pressure chamber 70, which in this case is now high, is applied to the control chamber 56 and, through a fluid switch 93, to the control chamber 62. The higher pressure closes the waste and supply valves of the respective load ports 26 and 28.

Although not shown, it can be understood from FIG. 1 that, with the solenoid deenergized, spring 23 forces the armature 21 down, and the valve member 76 is pushed up against its upper valve seat to close port 84. The chamber 80 is thereby closed to ambient pressure and open to the high pressure of conduit 67. That high pressure is now applied through conduit 86 to the control chambers 48 and 64 to close the supply and waste diaphragm valves to the respective ports 26 and 28.

The high pressure in conduit 86 is also applied to the control pressure chamber 88 of the pressure reversing valve 74. The valve member 72 is now subjected to high pressure forces from both above and below the valve member. However, the pressure area of the control diaphragm 90 is greater than the seat area of the high pressure port 68 so the valve member is forced upward by the diaphragm 90. The valve member rests against an upper valve seat of port 68 to close the reversed-pressure chamber 70 from the high pressure port 68 and to open the chamber to the ambient pressure above the diaphragm 90. Thus, low ambient pressure is now applied from the reversed-pressure chamber 70 to the control chambers 56 and 62, and the waste and supply diaphragm valves of the respective load ports 26 and 28 are opened.

It can be seen that supply diaphragm 40 and waste diaphragm 46 respond together to the pressure in conduit 86 which is determined by the pilot valve 20. The waste diaphragm 44 and the supply diaphragm 42 are operated together in an opposite manner in reponse to a reverse pressure obtained from the pressure reversing valve 74.

Several notable features of the valve of FIGS. 1 and 2 contribute to the reliable, self-powered nature of the piloted control. A control pressure higher than the supply pressure is obtained by the ram nozzle. All control conduits have substantial bores; no restrictions in these conduits are required. The system has no sliding parts. Further, only two pressure levels are required in the control, the higher pressure and lower, generally atmospheric, pressure. No additional pressures, which would complicate the system, are required to operate the pressure reversing valve 74.

In the state illustrated in FIG. 1, the supply valve diaphragm 40 is under direct control of the pilot valve 20. The left end of a rocker arm 100 of the fluid switch 87 is pressed down by a compression spring 102. The rocker arm 100 extends into a switch chamber 104 through a seal 106 and it pivots on the seal 106. In the position shown in FIG. 1, the end of the rocker arm 100 in the chamber 104 is pressed upward against a valve seat formed about a high pressure port 108. The high pressure port is in communication with the high pressure conduit 67 which is supplied by the ram nozzle 66. The pilot control pressure port 110, in communication with pilot control conduit 86, is left open in the case shown in FIG. 1. Conduit 86 is at a low pressure so that low pressure is passed through the switch chamber 104 to the conduit 112 and the control chamber 48. If the position of the pilot valve 20 were reversed, the pressure on conduit 86 would be high and that high pressure would be passed through to conduit 112 and the control chamber 48.

With low pressure applied through the fluid switch 87 to the chamber 48, the supply diaphragm 40 is open so that supply fluid passes from the supply port 24 to the load port 26. Load port 26 is in communication with a load pressure chamber 114 through an annulus 116 about the waste port 32. After the supply diaphragm 40 is opened, the pressure in the load port 26 increases approaching the pressure of the supply port 24. As that pressure in chamber 114 reaches a predetermined level established by the compression spring 102 of the fluid switch 87, the pressure in the load pressure chamber 114 applied to a diaphragm 118 is sufficient to press the diaphragm upward against an actuating rod 120. This movement of the rod 120 causes the rocker arm 100 to pivot to close the pilot control port 110 and open the high pressure port 108 to the fluid switch chamber 104. As a result, the pilot control pressure is no longer passed through to conduit 112 and control chamber 48. Rather, a high pressure flows into the chamber 48 to close the diaphragm 40 as shown in FIG. 2. Thus, as the load pressure reaches a predetermined value as determined by the pre-set level of the spring force, the supply valve to that load port is closed to limit the pressure in the load port. The value of the maximum pressure build-up in the load conduit 26 is determined by adjusting screw 122.

In some applications, it would be sufficient to provide a pressure limiting switch responsive to the load pressure in one load port by closing a single supply valve. The other load port would always receive the full line pressure. The supply and waste control valve of FIGS. 1 and 2, however, allows for control of the maximum pressure applied to each load port. To that end, a second fluid switch 93 identical to the switch 87 is provided in the control conduit between the reverse pressure chamber 70 of pressure reversing valve 74 and the supply valve control chamber 62. A rocker arm 124 pivots about a seal 126 to close either the reverse pressure control port 128 or the high pressure control port 130 in the chamber 131. A diaphragm 132 responds to the pressure in a load pressure chamber 134 which is in communication with the load port 28. The set point of the switch 93 can be set by an adjustment screw 136 independent of the set point of the fluid switch 87.

The supply and waste control valve of FIGS. 1 and 2 has the advantage of providing for both piloted control and pressure regulation to a load port with a single main diaphragm valve. When the supply valve is open, the main fluid flow is not restricted by any additional pressure regulation valve. Pressure regulation is obtained by modifying the control network to the main supply valve, not by an additional main valve. Even with one or more fluid switches, the main valve retains the advantage of being self-powered without the need for sliding parts or restrictions in the control conduits .

Figure 3:
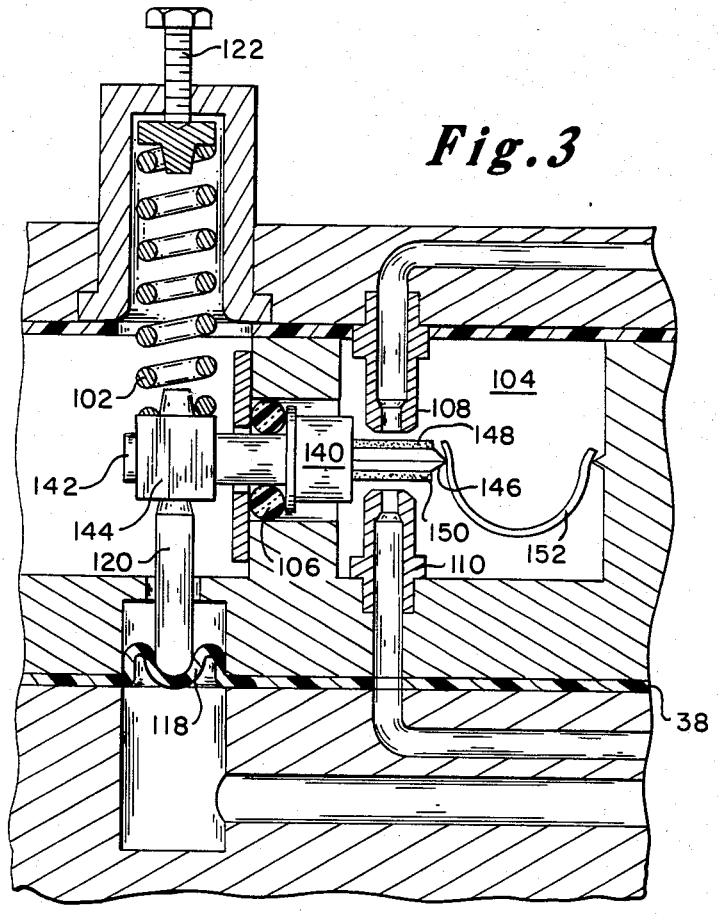
FIG. 3 is a detailed cross sectional view of a pressure limiting switch which may be used in the embodiment of FIGS. 1 and 2.

A detailed view of a preferred fluid switch for use in practicing the present invention is shown in FIG. 3. The load pressure sensing diaphragm 118 is premolded in the gasket 38. The rocker arm includes a hub 140 within the switch chamber 104. A rod 142 of circular or oblong cross section extends from the hub 140 through the O-ring seal 106 and supports a spring retaining element 144. A flat tab 146 extends in the opposite direction and supports opposing sealing pads 148 and 150. The pads 148 and 150 seal against the respective ports 108 and 110.

In some instances it is desirable to make the fluid switch bistable, and then a semicircular leaf spring 152 is positioned between the tab 146 and the wall of the chamber 104. The leaf spring is compressed between the wall and the tab 146 so that it provides a force on the tab which causes it to rock away from the center position shown in FIG. 3. As the tab 146 moves above the center position shown in FIG. 3, the force from the spring drives it further upward against the port 108. The rocker arm is then retained in that position by the compression spring 102 and the leaf spring 152. When sufficient pressure is applied to the diaphragm 118 to overcome the combined spring forces, the rocker arm pivots. Once it pivots through the center position shown in FIG. 3, the vertical component of the force from the leaf spring 152 on the tab 146 changes from an upward direction to a downward direction. Thus, the fluid pressure force and the force of the leaf spring 152 combine to retain the tab 146 down against the port 110.

Figure 4:
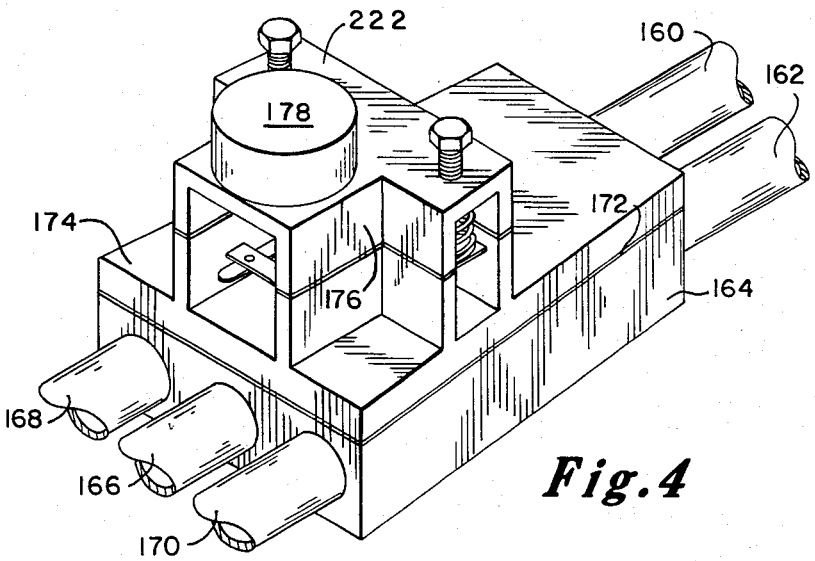
FIG. 4 is a perspective view of an alternative four-way supply and waste control valve embodying of the invention.

An alternative, preferred four-way supply and waste control valve having two pressure limiting switches is shown in FIGS. 4 through 10. As shown in FIG. 4, two load conduits 160 and 162 extend from a main fluid handling block 164. Supply fluid is applied to either of those load conduits from a supply conduit 166. Waste fluid from the load conduits can be vented through respective waste conduits 168 and 170 which extend from the opposite end of the block 164. As in the previous embodiment, all diaphragms in the valve are formed in a single sheet 172 which also serves as a gasket between the main block 164 and a control block 174. A raised section 176 of the control block 174 houses dual chambers of a pilot control valve actuated by a solenoid 178 and two load responsive fluid switches.

Figure 6:
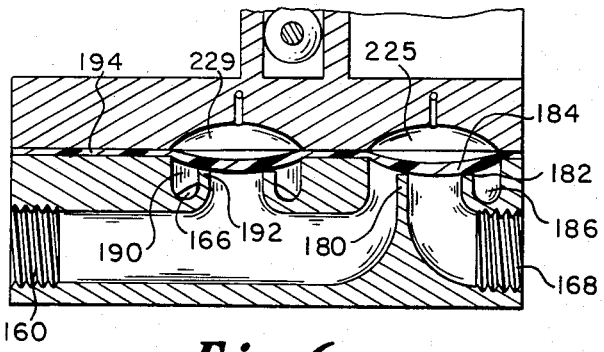
FIG. 6 is a cross sectional view of the valve of FIG. 4 taken along line 6—6 of FIG. 5.
Figure 7:
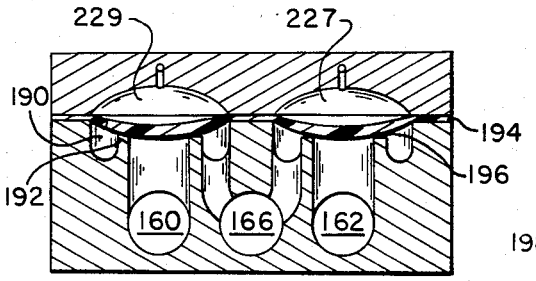
FIG. 7 is a cross sectional view of the valve of FIG. 4 taken along line 7—7 of FIG. 5.
Figure 9:
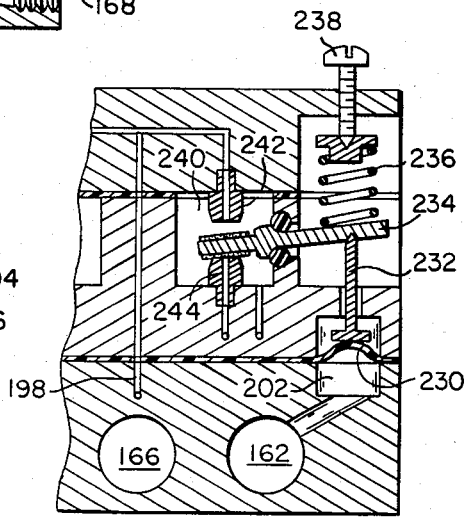
FIG. 9 is a partial cross sectional view of the valve of FIG. 4 taken along line 9—9 of FIG. 8.

The arrangement of the main control valves is best seen in FIGS. 5, 6 and 7. FIG. 5 is a plan view of the block 164 with the control block 174 and gasket 172 removed. FIGS. 6 and 7 are cross sectional views of the valve. As shown in FIGS. 5 and 6, the waste conduit 168 communicates with a vertical waste conduit 180 which terminates at an annular valve seat 182. When the diaphragm 184 of that waste valve is open, the waste conduit 180 communicates with an annulus 186 which in turn communicates with the load conduit 160. In a similar fashion, the waste conduit 170 communicates with the load port 162 past the valve seat 188.

The load conduit 160 can also communicate with a supply annulus 190 past an annular valve seat 192 when a diaphragm 194 is open. As shown in FIG. 7, the supply annulus 190 communicates with the supply conduit 166.

In a similar fashion, the supply conduit 166 can communicate with the load conduit 162 past the valve seat 196.

As viewed in FIG. 5, it can thus be seen that supply fluid is supplied to the load conduit 160 by a diaphragm valve in the upper left quadrant and exhausted through a waste valve in the lower left quadrant. Fluid is supplied to the load conduit 162 through a supply diaphragm valve in the upper right quadrant and is exhausted from the load conduit 162 through a waste diaphragm valve in the lower right quadrant.

As in the previous embodiment, a ram nozzle may be positioned in the conduit 166 to provide a high control pressure at conduit 198. Two load-pressure chambers 200 and 202 are in communication with the respective load conduits 160 and 162.

Figure 8:
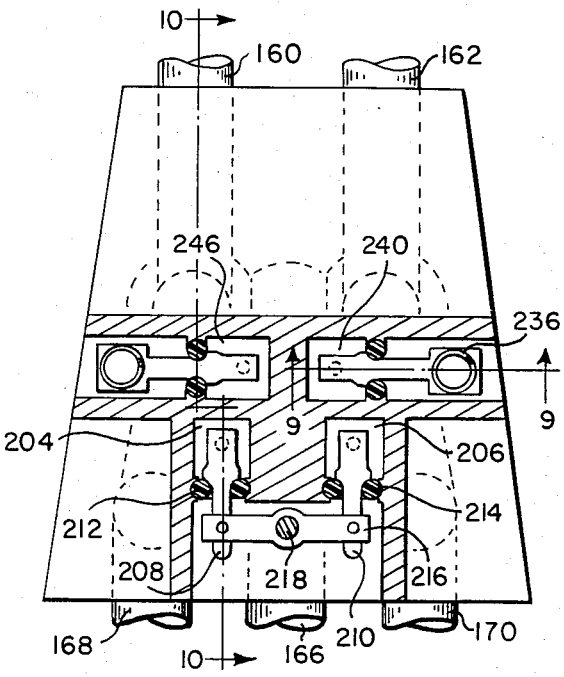
FIG. 8 is a plan view of the valve of FIG. 4 with the top plate of the control block removed.

The arrangement of the dual pilot valve and the pressure limiting fluid switches is shown in FIGS. 8 and 10. In the previous embodiment, a pilot valve controlled the control pressure applied to one pair of diaphragm valves and a pressure reversing valve was responsive to the pilot control pressure to provide a reversed pressure to the remaining pair of diaphragm valves. In the present embodiment, a single four-way pilot valve is controlled by a single solenoid 178 to provide a first pilot control pressure and a reversed pilot control pressure. As shown in FIG. 8, the four-way pilot control valve comprises side-by-side control pressure chambers 204 and 206. Respective rocker arms 208 and 210 extend into those chambers through O-ring seals 212 and 214. The rocker arms are identical to that shown in the fluid switch of FIG. 3. The two rocker arms are joined by an equalizing bar 216 which is loosely pinned to each of them. The equalizing bar is driven by an armature 218 of the solenoid 178 (FIG. 10).

When the solenoid 178 is not energized, a compression spring 220 forces the armature 218 downward. As a result, each rocker arm pivots to close an upper port in the cover plate 222 of the control block. The upper port 224 of the pilot chamber 204 shown in FIG. 10 is connected to a high pressure conduit from conduit 198 shown in FIG. 5. The lower port 228 communicates with atmosphere. Thus, with the solenoid 178 not energized, the high pressure port 224 is closed and the chamber 204 is open to atmosphere through port 228. A pilot control conduit (not shown) leads from the chamber 204 directly to a control chamber over the waste diaphragm valve for load conduit 162 and, through a fluid switch, to the control chamber 229 above the supply diaphragm valve associated with the load conduit 160.

The rocker arm 210 also acts to close either of two ports in the chamber 206, but the ports are inverted relative to those in chamber 204. Thus, with the solenoid not energized the rocker arm 210 closes an upper port which is vented to atmosphere and opens a bottom, high pressure port. The resultant high pressure in the chamber 206 is applied through control conduits to the control chamber 225 over the waste valve to load conduit 160 and, through the remaining fluid switch, to the remaining control chamber 227 over the supply valve to conduit 162.

As the solenoid is energized, the armature 218 is pulled up to reposition the rocker arms 208 and 210 and reverse their fluid pressures. This reverses the control of the four main diaphragm valves in the same manner that the pilot and pressure reversing valves of the previous embodiment reverse the state of those main diaphragm valves.

The fluid switches operate in the same manner as the fluid switches of the previous embodiment. Thus, the load pressure in chamber 202 (FIG. 9) acts on the control surface of a diaphragm 230. When the load pressure in load conduit 162 reaches a predetermined level, the diaphragm 230 presses a rod 232 upward to cause the rocker arm 234 to pivot against the force of a compression spring 236. The force of the compression spring 236, and thus the pressure level at which the switch is actuated, is set by an adjusting screw 238. The rocker arm 234 is the actuator of a supply and pass through valve. The fluid switch chamber 240 has a high pressure port 242 and a pilot control pressure port 244 from the pilot chamber 206.

High pressure is applied to the upper port in each of the fluid switch chambers 240 and 246, and the lower port in each fluid switch is in communication with a respective pilot chamber 206, 204. The pressure developed in the switch chamber 240 is applied to the control chamber 227 over the supply valve to load conduit 162; the pressure of switch chamber 246 is applied to the control chamber 229 over the supply valve to load conduit 160.

Figure 11:
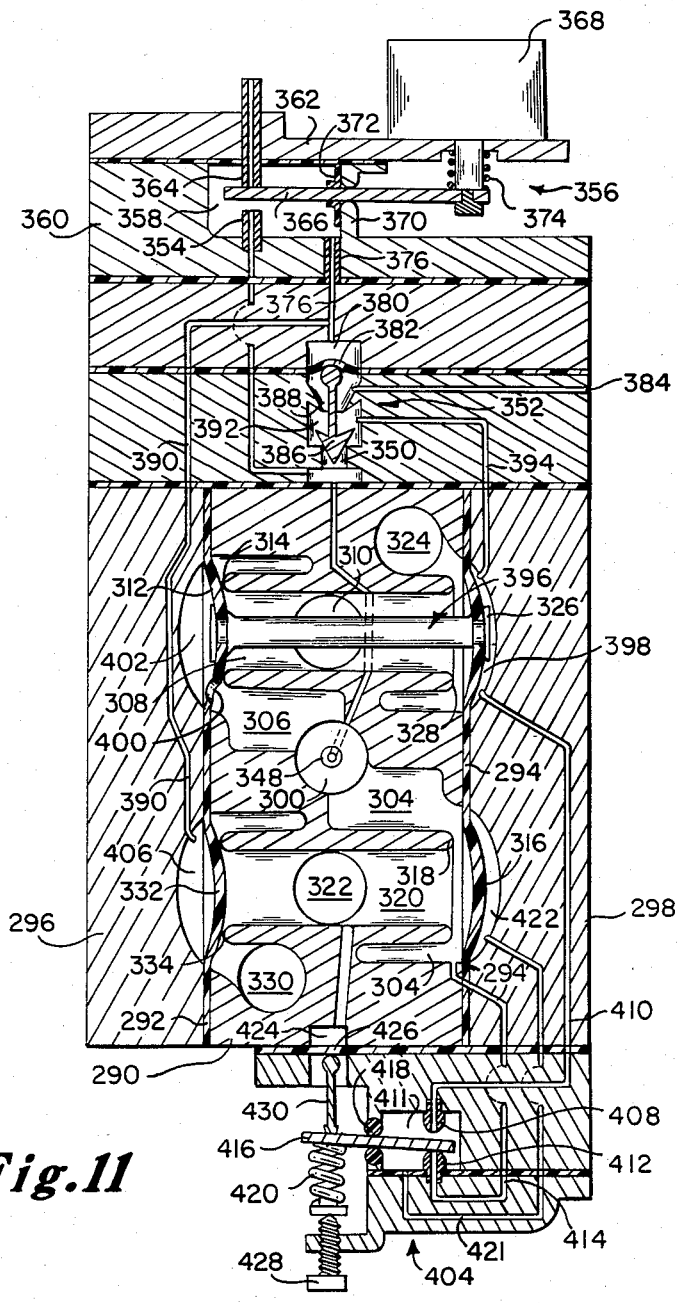
FIG. 11 is a cross sectional view of an alternative embodiment of the invention incorporating a single limit switch in a four-way supply and waste control valve.

FIG. 11 is a cross sectional view of an alternative four-way supply and waste control valve. The main fluid handling conduits are formed in a center block 290. The main supply and waste diaphragms are formed in gaskets 292 and 294 between side plates 296 and 298.

All of the supply, waste, and load ports of the valve of FIG. 11 are directed perpendicular to the plane of the drawing and, in this case, all extend through the far side of the valve. A supply port 300 is provided at the center of the main valve block 290. It communicates with two annuluses 304 and 306. As shown, a supply conduit 308 from the annulus 306 to load port 310 is closed by a diaphragm 312 pressed against an annular valve seat 314. On the other hand, diaphragm 316 is positioned away from its valve seat 318 so that supply fluid flows from the annulus 304 through conduit 320 to a second load port 322. Conversely, the load port 310 is open to an exhaust port 324 past the open diaphragm 326 and its valve seat 328; and load port 322 is closed to a waste port 330 by a diaphragm 332 pressed against its valve seat 334.

As in prior embodiments, a higher control pressure is obtained by means of a ram nozzle 348 centered in the supply port 300. Ram nozzle 348 communicates with a high pressure port 350 to a pressure reversing valve 352 and with a high pressure input 354 to a pilot valve 356.

In the pilot valve 356 a pilot control pressure chamber 358 is formed in the block 360 and closed by a cap 362. A low pressure port 364, open to atmosphere, is positioned opposite to the high pressure port 354. One or the other of the high and low pressure ports 354 and 364 is closed by a rocker arm 366 which is actuated by a solenoid 368. The arm 366 is a flexible vane which extends through a slot in the side wall 370 of the pilot control pressure chamber 358. A collar seal 372 prevents leakage of high pressure gas from the chamber 358.

A compression spring 374 closes the low pressure port 364 when the solenoid 368 is not energized. When the solenoid is energized, the vane 366 pivots on the wall 370 and closes the high pressure port 354. With the high pressure port closed, the pressure applied from the chamber 358 to a control conduit 376 changes from a high control pressure to a low control pressure.

As in the embodiment of FIG. 1, the control pressure determined by the pilot valve is applied to a control pressure chamber 380 of the pressure reversing valve 352. The control pressure is applied to one face of a diaphragm 382, and the opposite face of the diaphragm is exposed to atmosphere through a conduit 384. With a high pressure in conduit 376 and control pressure chamber 380, the diaphragm is pressed down, as viewed in FIG. 11, to close the valve member 386 against the high pressure port 350 and open a low pressure port 388. Thus, as high pressure is applied to conduit 376 and then to conduit 390, low pressure is applied from the reversed pressure chamber 392 through a conduit 394.

On the other hand, when the solenoid 368 is actuated and the high pressure port 354 is closed, low, atmospheric pressure control fluid is applied to the conduit 390 and to the control pressure chamber 380. The high pressure in port 350 moves the valve member 386 upward to close the low pressure port 388 in the pressure reversing valve and open the high pressure port 386 to the reversed-pressure chamber 392. Thus, high pressure is applied to conduit 394.

In the embodiment of FIG. 11, a pressure limiting switch is not included in the control of the supply diaphragm 312. Further, the supply diaphragm 312 and waste diaphragm 326 are joined by a tierod 396 so that they are actuated simultaneously by the control pressure in a single control chamber 398 which communicates with the control conduit 394. To that end, a perforation 400 is provided in the diaphragm 312 so that the control chamber 402 is always at the level of the supply pressure. As a result, when the pressure in the control chamber 398 is low the supply pressure drives the diaphragms 312 and 326 to the right as viewed in FIG. 11 to close the load port 310 from the supply and to open that port to waste port 324. On the other hand, when the pressure in control chamber 398 is high the diaphragm 326 and thus diaphragm 312 are both driven to the left to close the waste diaphragm 326 and open the supply diaphragm 312.

The supply diaphragm 316 to the load port 322 is controlled independently through a fluid switch 404 so the supply diaphragm 316 and the waste diaphragm 332 cannot be joined by a tierod. Diaphragm 332 is controlled by the pressure in control chamber 406 which communicates with the control conduit 390.

The reversed control pressure on conduit 394 is applied through the control chamber 398 and a conduit 410 to a control pressure port 408 in the chamber 411 of the fluid switch. High pressure is applied to the high pressure port 412 through a conduit 414 which communicates with the supply annulus 304. As in the previous embodiments a rocker arm 416 pivots on a seal 418 and is normally pressed against the high pressure port 412 by the compression spring 420. In that state, the control pressure on conduit 394 is passed through the fluid switch to the control chamber 422 behind supply diaphragm 316. A load pressure chamber 424 communicates with the load port 322 and the pressure in that chamber is applied to the control surface of a diaphragm 426. When the pressure in the load chamber 424 reaches a predetermined level set by the adjusting screw 428, it presses the rod 430 downward to cause the rocker arm 416 to pivot. The control pressure port 408 is thus closed and high pressure is applied from the high pressure port 412 through the fluid switch chamber 411 and conduit 421 to the supply control chamber 422.

To summarize the operation of the valve in FIG. 11, the solenoid actuated pilot valve 356 and the pressure reversing valve 352 act to provide a high or low control pressure on conduit 390 and a reversed low or high control pressure on conduits 394 and 410. The supply and waste diaphragms 312 and 326 to the load port 310 respond together to the pressure in control chamber 398 from conduit 394. The waste diaphragm 332 for the load port 322 responds to the pressure in conduit 390. The supply diaphragm 316 initially responds to the pressure in conduit 394 and 410 through the supply and pass through fluid switch 404. When the pressure in the load port 322 reaches a preset value, the fluid switch 404 causes high pressure to be applied to the control side of diaphragm 316 to close that diaphragm and thus limit the pressure in the load port 322.

An alternative to the diaphragms 312 and 326 joined by the tierod 396 is shown in FIG. 12. In this arrangement, poppet valve members 440 and 442 and the piston 443 with its seal ring 445 are joined by a tierod 444. The poppet valves are controlled by the pressure in the control chamber 446. As shown, low pressure in control chamber 446 permits the poppet valve assembly to be pushed to the right by the supply pressure in the supply pressure chamber 448 to close the poppet 440 against its valve seat 450 and to push the poppet 442 and its associated piston 443 away from its valve seat 452. On the other hand, high pressure contained within the control chamber 446 and applied to the surface area of the piston 443, with a pressure area larger than the area of the annular seat 450, pushes the piston, the rod and poppet assembly to the left to close the waste poppet 442 and open the supply poppet 440. The tie-rod is radially constrained by a number of guide fingers 451 attached to conduit 453.

Figure 13:
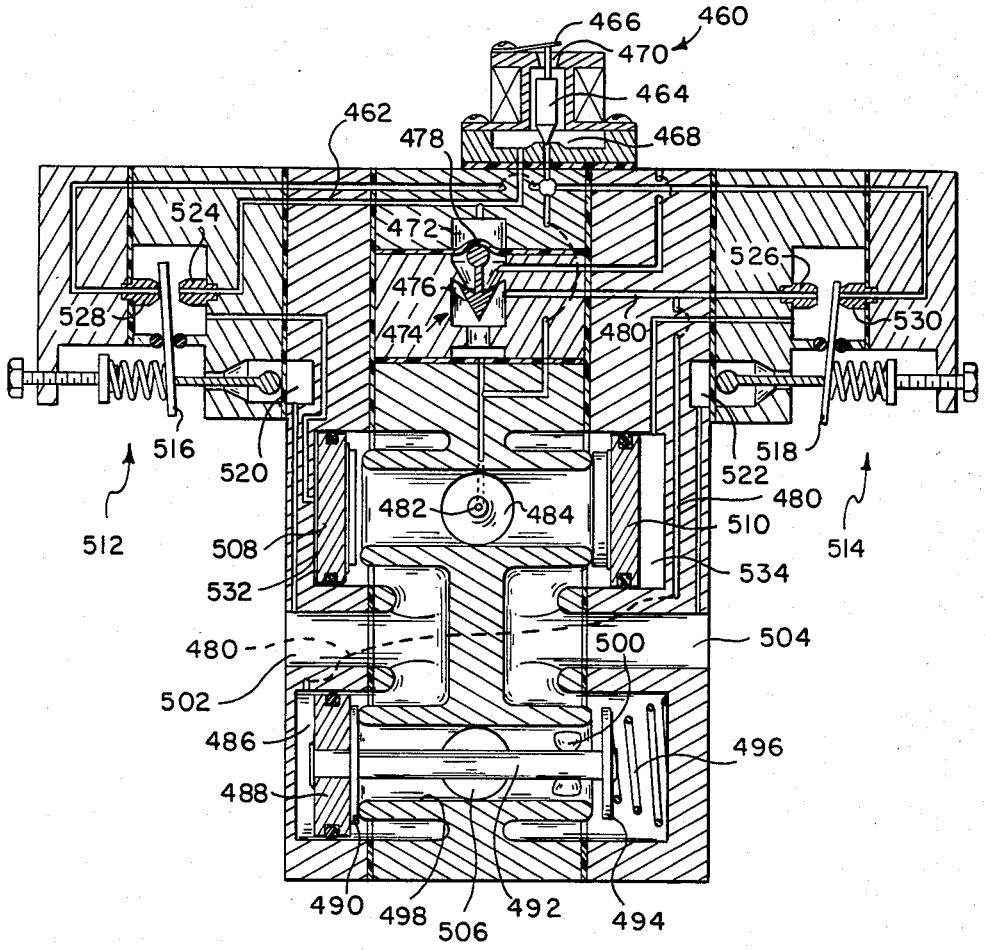
FIG. 13 is yet another embodiment of the invention incorporating two fluid switches in a four-way supply and waste control valve.

FIG. 13 shows an alternative four-way supply and waste control valve. The valve utilizes poppet valves rather than diaphragm valves and has a fluid switch associated with each of the supply valves. The two waste valves are joined by a tierod.

As in previous embodiments, a solenoid actuated pilot valve 460 provides a high or low pressure on control conduit 462. In the valve 460 the solenoid armature 464 serves as the valve member. When the solenoid electric coil is energized, the armature is driven against a leaf spring 466 to open a high pressure port 468 and close a low pressure port 470. The pressure in the conduit 462 is applied to the pressure control chamber 472 of a pressure reversing valve 474 to actuate the valve member 476 through a diaphragm 478. The pressure reversing valve 474 provides a reversed control pressure on conduit 480. High pressure conducted to the pilot valve 460 and the pressure reversing valve 474 is obtained from a ram nozzle 482 in the supply port 484.

The reverse control pressure on conduit 480 is applied directly to a control chamber 486 behind a piston element 488. With high pressure in the chamber 486, the piston element 488 drives a poppet valve member 490, a tierod 492 and a poppet valve member 494 to the right. With low pressure in the chamber 486, a return spring 496 drives the poppet assembly back to the left. The poppet assembly is centered within a waste conduit 498 by centering fingers 500. The position of the poppet assembly determines which of the load ports 502 and 504 communicate with the waste port 506.

The supply valves are independent poppet valves controlled by respective pistons 508 and 510. The piston 508 controls the supply valve to load port 502 and responds to the fluid switch 512. The piston 510 controls the supply valve to the load port 504 and responds to the fluid switch 514. The fluid switches 512 and 514 are identical to those previously described. Thus, the respective rocker arms 516, 518 are actuated by diaphragms 520, 522, the control surfaces of which are exposed to the load pressures. When the respective load pressures are below predetermined set values, the switches pass through the control pressures on conduits 462 and 480. When either responds to the load pressure at the set point, the respective control port 524, 526 is closed and high pressure is applied to the switch through respective port 528, 530. The pressures in the respective switch chambers are applied to the control chambers 532, 534 behind the valve pistons 508 and 510.

Figure 14:
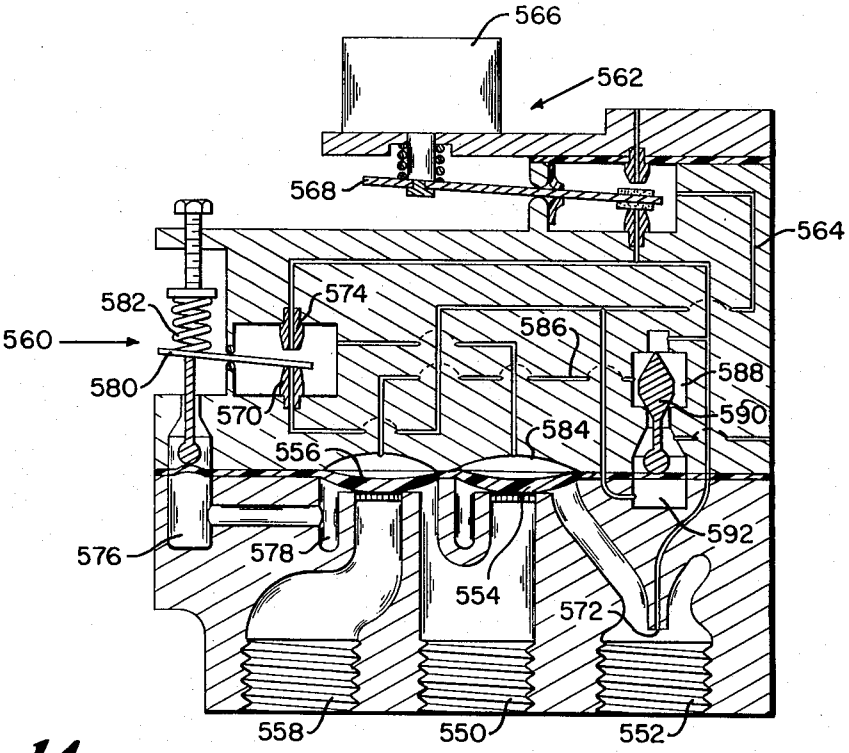
FIG. 14 is a cross sectional view of a three-way supply and waste control valve embodying the present invention.

FIG. 14 illustrates a three-way supply and waste control valve. A three-way valve includes a single load port 550 to which supply fluid is supplied from a supply port 552 past a supply diaphragm 554 or from which fluid is vented past a diaphragm 556 through a waste port 558. The control pressure to the supply diaphragm 554 is obtained, through a pressure limiting switch 560, from a solenoid actuated pilot valve 562. The pilot valve 562 has previously been described, and it provides a high or low control pressure on conduit 564 in response to the solenoid 566 which actuates a rocker arm 568. The pressure in conduit 564 is applied to the control pressure port 570 of the fluid switch 560 and a high pressure from the ram nozzle 572 is applied to the high pressure port 574 of the fluid switch.

The load pressure chamber 576 communicates with a load annulus 578. When the pressure in the chamber 576 reaches a predetermined level, it drives the rocker arm 580 against the compression spring 582 with sufficient force to overcome the spring and thereby rotate the rocker arm to close the control port 570 and open the high pressure port 574. As a result, pressure applied to the control chamber 584 goes high to close the diaphragm 554.

The waste diaphragm 556 is controlled by the reversed pressure output 586 from the pressure reversing valve 588 which is identical to those previously described. That is, the position of the valve member 590 is determined by the pressure in control pressure chamber 592 which is the pilot control pressure from conduit 564.

While the invention has been particularly shown and described with reference to preferred embodiments thereof, it will be understood by those skilled in the art that various changes in form and details may be made therein without departing from the spirit and scope of the invention as defined by the appended claims. For example, the fluid switch can be incorporated into any number of valve designs in which the supply valve is actuated by a fluid pressure. For example, see my copending patent application "Pilot Operated Supply and Waste Control Valve" Ser. No. 602,438, filed Apr. 20, 1984. Also, although rocker arm valve members have been shown as the preferred design for the fluid switch, other switches could be utilized. For example, the valve design utilized for the pressure reversing valves could be utilized as a fluid switch.

I claim:

1. A pilot operated supply and waste control valve of the type comprising two main diaphragm valves communicating with a load port for alternately supplying and exhausting a supply fluid to and from the load port and control valve means for directing fluid control pressure to a control surface of the main supply valve to open and close the supply valve and for directing a reversed pressure to a control surface of the main waste valve to conversely close and open the waste valve, the supply and waste control valve further comprising:

a fluid switch, responsive to load pressure at the load port, connected between the control valve means and the control surface of the main supply valve and having a switch output in communication with the control surface of the main supply valve, the switch having a movable switch member which connects the control pressure from the control valve means to the switch output in a first position and which connects a valve closing pressure level, which closes the main supply valve, to the switch output when the switch member is in a second position.

2. A fluid supply valve as claimed in claim 1 wherein the control valve means includes a pilot control valve which provides high and low pilot control pressures and a pressure reversing valve which provides control pressures which are the reverse of the pilot control pressures.

3. A fluid supply valve as claimed in claim 1 wherein the control valve means is a dual output pilot valve.

4. A fluid supply valve as claimed in claim 1 wherein the fluid switch is actuated by a diaphragm in fluid communication with the load port and the diaphragm of the fluid switch and the diaphragms of the main valves are formed in a single sheet of material.

5. A fluid supply valve as claimed in claim 4 wherein the switch member is a rocker arm which is actuated by the diaphragm to pivot between first and second positions, the rocker arm in the second position closing a control port which receives the fluid control pressure from the control valve means and in the first position closing a high pressure port to the switch.

6. A fluid supply valve as claimed in claim 4 wherein the control valve means comprises two control valves and wherein one of the control valves is a pilot control valve which provides high and low pilot control pressures and the other control valve is a pressure reversing valve which provides control pressures which are the reverse of the pilot control pressures.

7. A fluid supply valve as claimed in claim 4 wherein the control valve means is a dual output pilot valve, each output being one of high and low pressure levels and each output being the reverse of the other output.

8. A fluid supply valve as claimed in claim 1 wherein the pressure level which closes the main supply valve is taken from the supply pressure.

9. A pilot operated three-way supply and waste control valve comprising a main supply valve and a main waste valve for alternately supplying and exhausting supply fluid to and from a load port, control valve means responsive to a control input for opening and closing the main supply and waste valves, and a fluid switch responsive to the fluid pressure in the load port for closing said main supply valve when the fluid pressure in the load port reaches a preset value independent of the control input to the control valve means, each of the main valves and the fluid switch being driven by fluid pressure taken from the supply fluid.

10. A pilot operated four-way supply and waste control valve comprising two main supply valves and two main waste valves for alternately supplying and exhausting supply fluid to and from two load ports, control valve means responsive to a control input for opening and closing the main supply and waste valves, and a fluid switch responsive to the fluid pressure in one of said load ports for closing a main supply valve to said load port when the fluid pressure in said load port reaches a preset value independent of the control input to the control valve means, each of the main valves and the fluid switch being driven by fluid pressure taken from the supply fluid.

11. A pilot operated four-way supply and waste control valve comprising two main supply valves and two main waste valves for alternately supplying and exhausting supply fluid to and from two load ports, control valve means responsive to a control input for opening and closing the main supply and waste valves, and two fluid switches, each in communication with a load port and the supply valve to that load port, each fluid switch being responsive to the fluid pressure in a load port for closing a main supply valve when the fluid pressure in the load port reaches a preset value independent of the control input to the control valve means, each of the main valves and fluid switches being driven by fluid pressure taken from the supply fluid.

12. A pilot operated supply and waste control valve comprising:

a first block having fluid handling conduits therein, including first and second load conduits, and supply and waste conduits, and valve seats for supply and waste diaphragm valves between each of the load conduits and the supply and waste conduits;

a flexible gasket adjacent to a face of the first block, the gasket having diaphragms formed therein positioned over the valve seats of the supply and waste valves and at least one pressure sensing diaphragm in communication with a load conduit;

a second block having control conduits and valve control chambers formed therein and pressing the gasket against the first block, the second block having a respective control chamber positioned over each main valve diaphragm and having two control pressure chambers of control valve means formed therein, one control pressure chamber directing fluid control pressure to control chambers over a main supply valve diaphragm associated with one load conduit and a main waste valve diaphragm associated with the other load conduit and the other control pressure chamber directing a reverse pressure to the control chambers over the remaining two main valve diaphragms, and the second block further having at least one fluid switch chamber of a fluid switch, the fluid switch chamber having an inlet in communication with a control pressure chamber, another inlet connected to a pressure level for closing a main supply diaphragm valve and a switch outlet in communication with a control chamber over a main supply valve diaphragm, there being a movable switch member in the switch chamber responsive to the pressure sensing diaphragm for alternately closing the inlets to the switch chamber.

* * * * *